United States Patent [19]

Menjo

[11] Patent Number: 5,068,692

[45] Date of Patent: Nov. 26, 1991

[54] ROTATORY MEMBER FOR FIXING AND FIXING DEVICE HAVING THE ROTATORY MEMBER

[75] Inventor: Takeshi Menjo, Tokyo, Japan

[73] Assignee: Canon Kabushiki Kaisha, Tokyo, Japan

[21] Appl. No.: 529,508

[22] Filed: May 29, 1990

[30] Foreign Application Priority Data

May 31, 1989 [JP] Japan ..... 1-135740

[51] Int. Cl.[5] ..... G03G 15/20

[52] U.S. Cl. ..... 355/284; 355/282; 355/285; 355/327

[58] Field of Search ..... 355/284, 282, 285, 295, 355/289, 290, 326, 327, 328; 219/469, 201, 216, 243, 244; 118/60

[56] References Cited

U.S. PATENT DOCUMENTS

| | | | |
|---|---|---|---|
| 4,050,886 | 9/1977 | Moser | 219/469 X |
| 4,352,551 | 10/1982 | Iwao | 355/284 |
| 4,596,920 | 6/1986 | Inagaki | 219/216 |
| 4,842,944 | 6/1989 | Kuge et al. | 355/285 X |

FOREIGN PATENT DOCUMENTS

| | | |
|---|---|---|
| 50-48928 | 5/1975 | Japan . |
| 60-48752 | 10/1985 | Japan . |

*Primary Examiner*—A. T. Grimley
*Assistant Examiner*—Sandra L. Hoffman
*Attorney, Agent, or Firm*—Fitzpatrick, Cella, Harper & Scinto

[57] ABSTRACT

The present invention presents a rotatory member for fixing toner image onto a support member supporting toner image, which is constituted of a core member, an elastic layer provided on the core member, an intermediate layer provided on the elastic member, and a surface layer provided on the intermediate layer. The whole elastic layer is covered with the above intermediate layer, and also the coverage with the above intermediate layer is extended to the portion which blocks movement of the mold release agent provided around the journal portion of the core member. With such constitution, contamination within the main device with the mold release agent reaching from the rotatory member to the main device can be prevented.

20 Claims, 4 Drawing Sheets

ROTATORY MEMBER FOR FIXING AND FIXING DEVICE HAVING THE ROTATORY MEMBER

BACKGROUND OF THE INVENTION

1. Field of the Invention

This invention relates to a rotatory member for fixing for fixing toner image onto a support supporting toner image, and a fixing device having the rotatory member. Particularly, it pertains to a fixing device adapted to supply a mold release agent to a rotatory member for fixing for preventing the off-set phenomenon of toner.

2. Related Background Art

Many heating roller fixing devices have been employed in the art as the fixing device for fixing unfixed toner image onto a support member in image forming devices such as copying machines, electrophotographic printers, etc., and for preventing the off-set phenomenon of toner onto the roller, it has been generally practiced to supply a mold release agent such as silicone oil, etc. to the roller.

Particularly, in full-color image forming device which forms a full-color image by mixing toners with plural different colors, mold releasability of the roller relative to toner is strongly demanded, and therefore a large amount of a mold release agent is supplied to the roller.

Whereas, for the fixing roller to be used for full-color image forming device, not only high mold releasability, but also its elasticity is demanded from aspect of improvement of fixability, and a fixing roller having elastic member layers such as of rubber, etc. laminated is employed. For example, a fixing roller obtained by coating successively a silicone rubber layer, a fluorine rubber layer, a silicone rubber layer coated on the outer peripheral of a core metal such as aluminum, etc. is employed. Among them, the fluorine rubber layer is a layer which functions as the oil barrier layer which prevents penetration of the silicone oil coated on the fixing roller into the silicone rubber layer of the lower layer. Thus, the oil barrier layer prevents particularly swelling of the silicone rubber layer of the lower layer with the silicone oil coated on the fixing roller, thereby preventing breaking of the fixing roller by the influence from heat and pressure.

As described above, the fixing roller to be used for full-color image forming device is coated with a large amount of a silicone oil, but all of the silicone oil coated is not brought away with the recording material during fixing, but a part of the silicone oil remains on the fixing roller. And, the silicone oil remained on the fixing roller moves to both ends of said fixing roller simultaneously with rotation of the fixing roller to flow out into the main image forming device by passing through the journal portions on both ends of the fixing roller, thereby commencing to contaminate internally of the device. Accordingly, as shown in FIG. 1, there has been made an attempt to prevent contamination within the machine with said silicone oil by preventing flow-out of the silicone oil into the main device by forming a mold release agent discharging portion h at the journal portion L of the fixing roller R to block the silicone oil moving to both ends of the fixing roller R and permit it to drop downwardly therefrom.

However, since the core metal made of aluminum and the silicone oil have mutually good wettability with each other and the silicone oil has no repellent force on the core metal, said silicone oil comes over to the mold release agent discharging portion h to reach the end of the journal portion L, further reaching the main device, causing ultimately contamination within the machine to occur similarly as in the prior art.

The present invention has been accomplished in view of the problems as mentioned above.

SUMMARY OF THE INVENTION

It is an object of the present invention to provide a rotatory member for fixing which can surely prevent contamination of an image forming device with a mold release agent and a fixing device having the rotatory member.

It is another object of the present invention to provide a rotatory member for fixing which can eliminates swelling deterioration with a mold release agent and a fixing device having the rotatory member.

Other objects than those mentioned above and the specific features of the present invention will become more apparent by reading the detailed description given below by referring to the accompanying drawings.

DETAILED DESCRIPTION OF THE PREFERRED EMBODIMENTS

Figure 1:
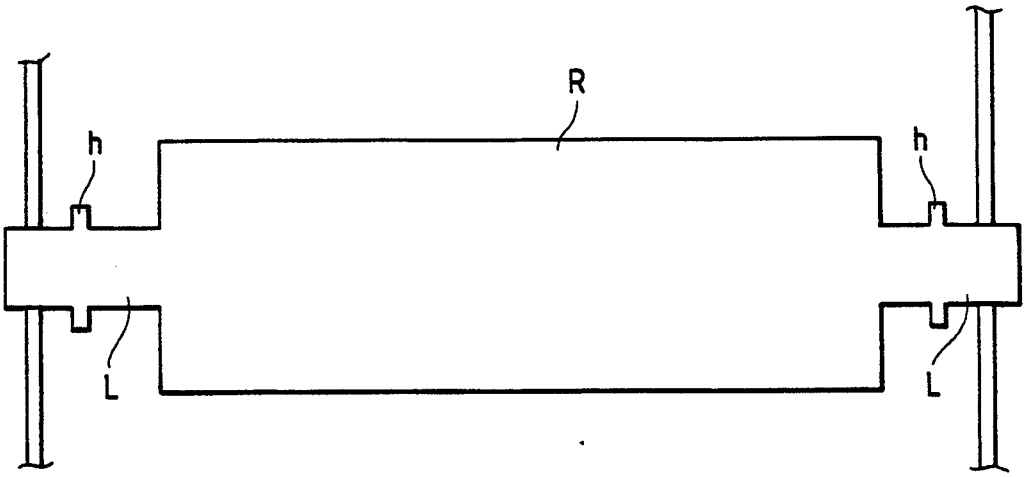
FIG. 1 is a schematic illustration of a fixing roller of the prior art.

Referring now to the drawings, embodiments of the present invention are to be described.

First, an image forming device to which the fixing device of the present invention is applicable is described.

Figure 2:
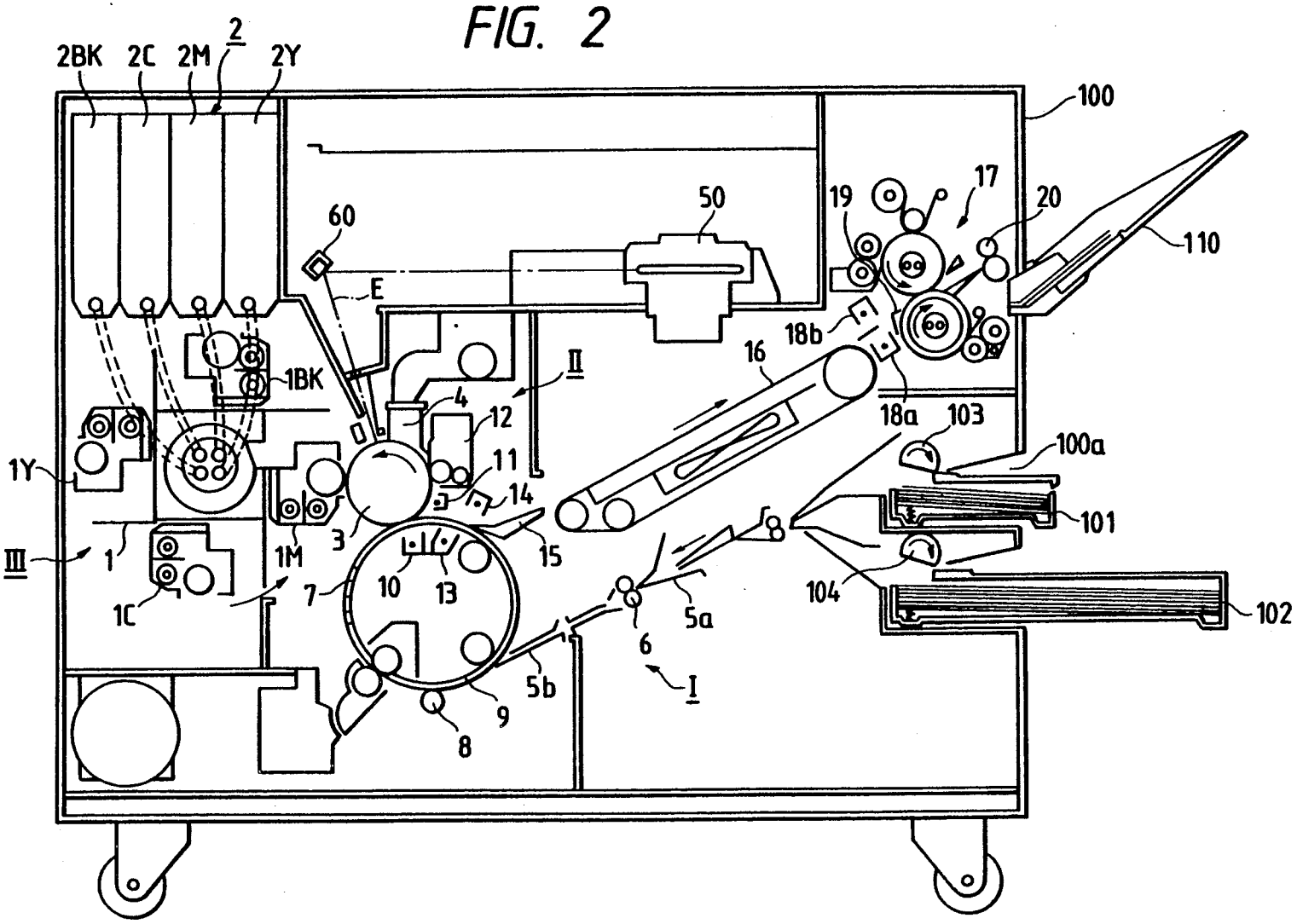
FIG. 2 is a schematic sectional view of an image forming device in which the fixing device applied with the present invention can be used.

FIG. 2 shows a constitution of an image forming device, and said image forming device is constituted of a transfer material conveying system I provided over from one side (right side in FIG. 2) of the main device 100 to approximate the center of the same main device 100, a latent image forming section II provided near the transfer drum 9 constituting the above transfer material conveying device I at approximate the center of the main device 100, a developing means, namely a rotatory system developing device III arranged near said latent image forming section II, and a developer supplementing means, namely a developer supplementing device 2 arranged near said rotatory system developing device III.

The above-mentioned transfer material conveying system I is constituted of trays 101, 102 for supplementing transfer material freely detachable relative to the opening 100*a* formed on one side (right side in FIG. 2) of the above main device 100, rollers for paper feeding 103, 104 arranged approximately directly above said trays 101, 102, paper feeding guides 5*a*, 5*b* arranged near these rollers for paper feeding 103, 104, a transfer drum 9 freely rotatable toward the arrowhead direction in FIG. 2 provided near the paper feeding guide 5*b* with a roller for contact 8, a gripper 7, a deelectrifier 14 for transfer material separation, a separating nail or pawl 15 arranged from the upstream side toward the downstream side in the rotation direction in the vicinity of the outer peripheral surface, and also a transfer charger 10 and a deelectrifier for transfer material separation 13 arranged on the inner peripheral surface, a conveying belt 16 provided near the above separating nail 15, a tray for discharging 110 freely detachable relative to the main device 100 arranged near the conveying direction terminal end side of said conveying belt 16 and extending outside of the main device 100, and a fixing device 17 according to the present invention provided near said tray for discharging 110.

The above-mentioned latent image forming section II is equipped with an image carrier freely rotatable in the arrowhead direction in FIG. 2 arranged with its outer peripheral surface in contact with the outer peripheral surface of the above transfer drum 9, namely a photosensitive drum 3, a deelectrifier 11, a cleaning means 12 and a primary charger 4 arranged from the upstream side to the downstream side in the rotation direction of the same photosensitive drum in the vicinity of the outer peripheral surface of said photosensitive drum 3, a photoirradiation means 50 such as laser beam scanner for forming electrostatic latent image on the outer peripheral surface of the photosensitive drum 3 and a reflection means 60 such as mirror.

The above-mentioned rotatory system developing device III has a freely rotatable rotatory member 1, and a magenta developing instrument 1M, a cyan developing instrument 1C, a yellow developing instrument 1Y and a black developing instrument 1BK respectively mounted on said rotatory member 1 for visualizing (developing) the electrostatic latent images formed on the outer peripheral surface of said photosensitive drum 3 at the positions opposed to the peripheral surface of said photosensitive drum 3.

Further, the above-mentioned developer supplementing device 2 is equipped with a yellow hopper 2Y, a magenta hopper 2M, a cyan hopper 2C and a black hopper 2BK arranged mutually adjacent to each other and holding the developers of the respective colors separately.

The sequence of the whole image forming device having the constitution as described above is descirbed briefly by referring to the case of full-color mode as an example.

When the above photosensitive drum 3 rotates in the arrowhead direction in FIG. 2, the photosensitive member of said photosensitive drum 3 is uniformly charged by the primary charger 4. When uniform charging is effected on the photosensitive member by the primary charger 4, image exposure is effected by the laser beam E modulated by the magenta image signal of an image information such as original, etc. (not shown), whereby an electrostatic latent image is formed on the photosensitive drum 3, and said electrostatic latent image is developed by the magenta developing instrument 1M positioned previously at the developing position by rotation of the rotatory member 1.

On the other hand, the transfer material conveyed by the paper feeding guide **5*a*, the paper feeding roller 6, the paper feeding guide 5*b* is held by the gripper 7 at a predetermined timing, and wound up electrostatically on the transfer drum 9 by the roller for contact 8 and the electrode opposed to said roller for contact 8. The transfer drum 9 rotates in the arrowhead direction in FIG. 2 as synchronized with the photosensitive drum 3, and the sensible image developed by the magenta developing instrument 1M is transferred by the transfer charger 10 at the site where the outer peripheral surface of the above photosensitive drum 3 is in contact with the outer peripheral surface of the above transfer drum 9. The transfer drum 9 continues to rotate as such to be prepared for transfer of the next color (cyan in FIG. 2**).

On the other hand, the photosensitive drum 3 is deelectrified by the above deelectrifier 11, cleaned by the cleaning means 12, and then charged again by the primary charger 4 and subjected to image exposure as described above by the next cyan image signal. The above-mentioned rotatory system developing device III rotates during formation of the electrostatic latent image by the cyan image signal by the above exposure on the photosensitive drum 3 to have the cyan developing instrument 1C positioned at a predetermined developing position, thereby effecting a predetermined cyan developing. Subsequently, the process as described above is also practiced respectively for yellow color and black color, and on completion of transfer corresponding to the four colors, the four color sensible images formed on the transfer material are deelectrified by the respective deelectrifiers 13, 14, whereby gripping of the transfer material by the above gripper 7 is released, and also said transfer material is separated by the separating nail 15 from the transfer drum 9 to be conveyed to the conveying belt 16.

Then, the transfer material is recharged before fixing by the chargers **18*a*, 18*b* before progressed into the fixing device 17, and further guided by the inlet guide 19 to be delivered to between the fixing roller 21 and the pressurizing roller 25 (see FIG. 4) as described below of the fixing device 17 and fixed by heating, followed finally by discharging out of the main device 100 by the paper discharging roller 20** which is a paper discharging guide member.

Thus, a series of full-color print sequence is completed to form a desired full-color print image.

Next, the toner which is the developing agent to be used in the image forming device is to be described.

The toner to be used of an image forming device of color is required to have good meltability and color mixability during application of heat thereon, and it is preferable to use a toner having low softening point and high sharp meltability with low melt viscosity. Thus, by use of such sharp melt toner, color reproduction range of copied material can be broadened to give a color copy faithful to the original image.

Such sharp melt toner is prepared by, for example, melting and kneading a polyester resin, a styrene-acrylic resin, a colorant (dye, sublimable dye), a charge controller, etc., pulverizing the mixture, followed by classification. If necessary, the external addition step of adding various external additives into the toner may be also added to the toner preparation step.

The color toner should be preferably one by use of a polyester resin as the binder resin, when fixability and sharp meltability are taken into consideration. The sharp meltable polyester resin is a polymeric compound having ester linkage in the main chain of molecule synthesized from a diol compound and a dicarboxylic acid.

Whereas, as the toner to be used for the image-forming device shown in FIG. 2, one by use of a sharp meltable polyester resin having its softening point of 60° C. to 150° C., preferably 80° C. to 120° C. is suitable.

Figure 3:
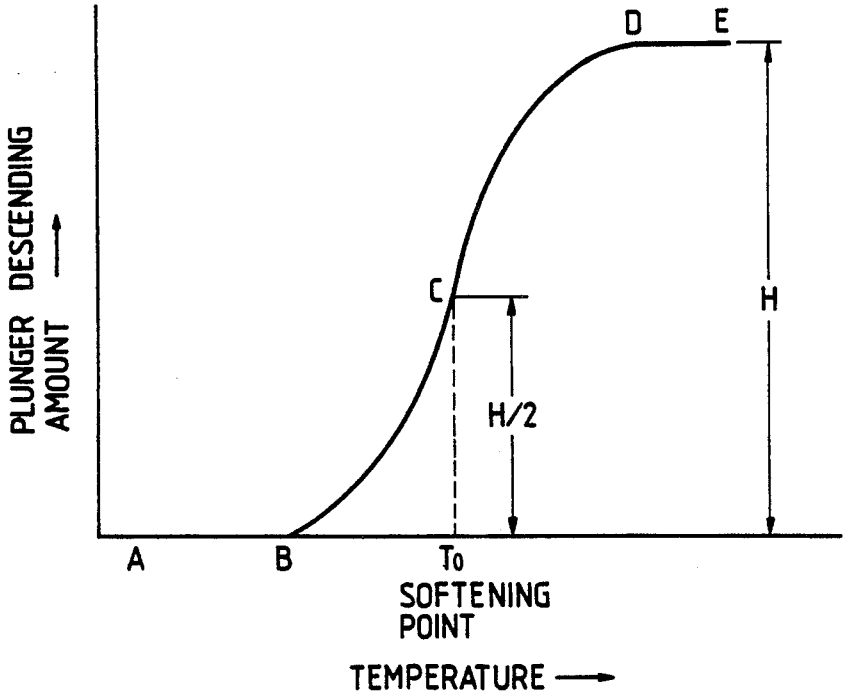
FIG. 3 is a graph showing the softening characteristics of toner.

The softening characteristic of the sharp melt toner is shown in FIG. 3.

The softening characteristic is obtained by use of a flow tester CFT-500 Model (Shimazu Seisakusho), by applying an extrusion load of 50 kg on a die (nozzle) with a diameter of 0.5 mm, a thickness of 1.0 mm, preheating at a predetermined setting temperature of 80° C. for a preheating time of 300 seconds, then elevating the temperature at equal rate of 5° C./min, and determining the plunger drop amount-temperature curve of the toner (hereinafter called "softening S-curve") drawn under such conditions. As the toner used for sample, 1 g to 3 g of purified fine powder is used, and the plunger sectional area is made 1.0 $cm^2$.

As the temperature is elevated at equal rate as shown in FIG. 3, the toner is gradually heated to begin to flow out (plunger drop A→B). And, when the temperature is further elevated, the toner under molten state greatly flows out (B→C→D), and the drop of the plunger stops (D→E). In FIG. 3, the height H of the softening S-curve indicates the total flow-out amount, and the temperature $T_0$ corresponding to the point C of H/2 indicates the softening point of the toner.

And, the sharp meltable resin refers to a resin, which satisfies the conditions of $T_1$=90° C.-150° C., and $|\Delta T| = |T_1 - T_2| = 5°$ C.-30° C., when the temperature at which the melt viscosity exhibits $10^5$ cp is defined as $T_1$, and the temperature when exhibiting $5 \times 10^4$ cp as $T_2$.

The sharp meltable resin having these temperature-melt viscosity characteristics is characterized by the fact that the viscosity is lowered extremely sharply by heating. Such lowering in viscosity effects adequate mixing of the uppermost toner layer and the lowest toner layer, and also increases abruptly transparency of the toner layer itself to enable good tone reduction mixing.

Whereas, such color toner with high sharp meltability has great affinity and is liable to be off-set onto fixing roller.

Figure 4:
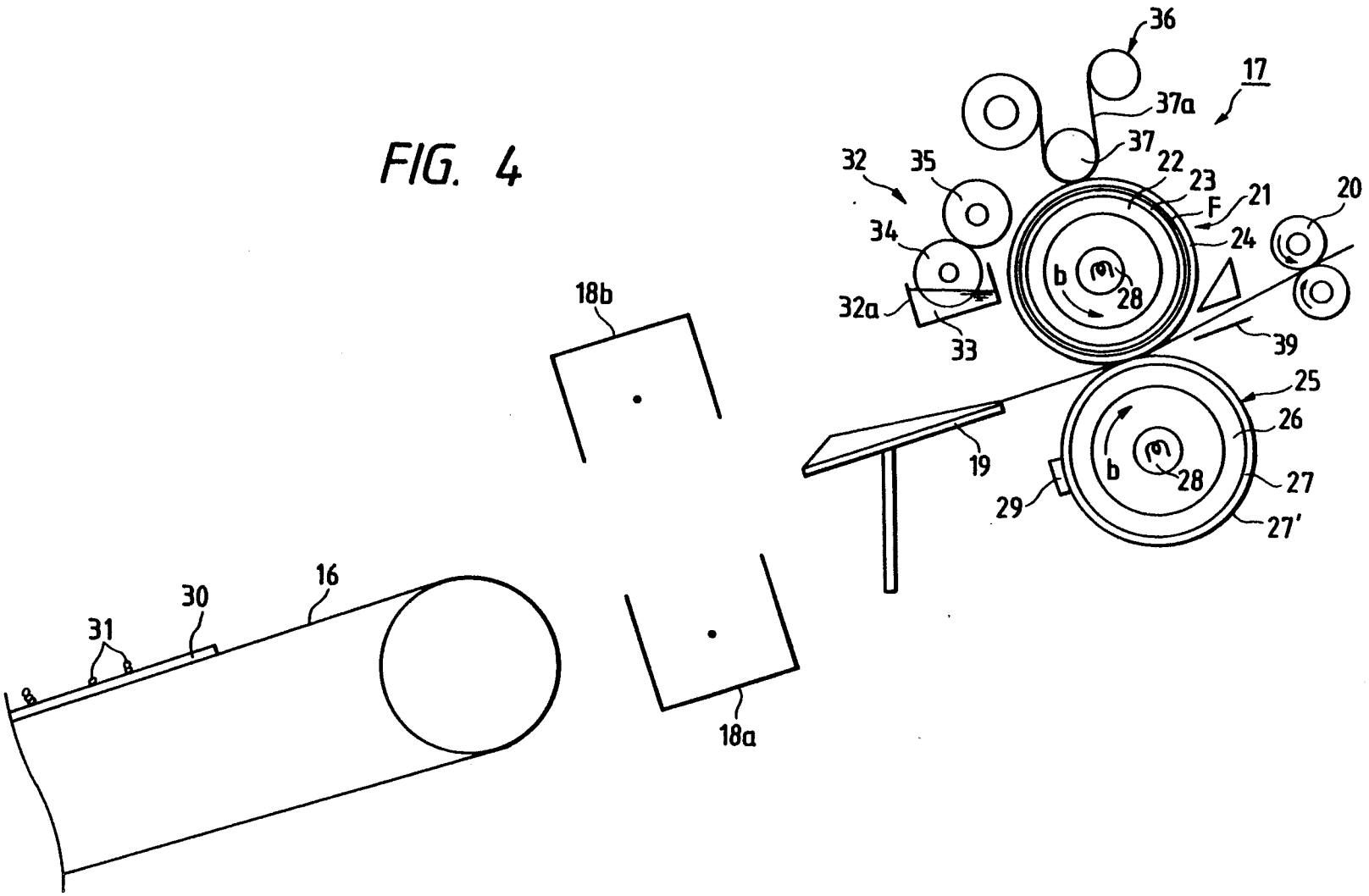
FIG. 4 is an enlarged sectional view around the fixing device.

Here, description is made about details of the above-mentioned fixing device 17 by referring to FIG. 4.

In FIG. 4, 21 is a fixing roller, which is constituted by coating the outer layer of the core metal 22 made of aluminum with an HTV silicone rubber (high temperature vulcanization type silicone rubber) 23 to a predetermined thickness, coating its outer layer with an oil barrier layer F of a fluorine rubber, and further coating its outer layer with an LTV silicone rubber (low temperature vulcanization type silicone rubber) 24 as the releasable surface layer to a thickness of 20 μm. And, at the lower side of the fixing roller 21 is provided a pressurizing roller 25, and said pressurizing roller 25 is constituted by coating the outer layer of the core metal 26 made of aluminum with an HTV silicone rubber 27 to a predetermined thickness, and further coating its surface layer with a resin film 27'. By such fixing roller 21 and pressurizing roller 25, this embodiment constitutes the rotatory member pair for fixing. Within the above mentioned fixing roller 21 and pressurizing roller 25 are respectively arranged halogen heaters 28 which are heating sources. And, with the pressurizing roller 25 is contacted a thermistor 29, and ON/OFF of supplying current to the halogen heater 28 is controlled by this thermistor 29. Thus, the surface temperatures of the fixing roller 21 and the pressurizing roller 25 are adapted so as to be maintained at suitable predetermined value (e.g. 170° C.) for fixing the unfixed toner image 31 on the transfer material 30 as the support material onto the transfer material 30. These fixing roller 21 and pressurizing roller 25 are driven by rotation in the arrowhead b direction shown by a driving device (not shown).

On the other hand, for improving releasability of toner from the fixing roller 21, a mold release agent coating device 32 is provided at a predetermined site of the fixing device 17. The mold release agent coating device 32 is constituted so that the silicone oil 33 as the mold release agent within the oil tank **32*a* may be coated onto the fixing roller 21 by roller group 34, 35** only in an amount of 0.1 g per sheet of transfer material A4 size.

Whereas, when a toner having high sharp meltability susceptible to off-set, fixing is performed by coating particularly the fixing roller 21 with a large amount of silicone oil.

The amount of silicone oil coated is determined as described below.

That is, when the weight of 50 sheets of transfer material (white paper) of A4 size is defined as A,a, and the weight of 50 sheets of the transfer material (white paper) after paper passage between the fixing roller and the pressurizing roller without transfer of image onto these transfer materials and without coating of silicone oil onto the off-set prevention layer of the fixing roller as B g, similarly the weight of 50 sheets of another transfer material (white paper) of A4 size as $A_2$ g, the weight of 50 sheets of the transfer material (white paper) without transfer of image onto the transfer material but with coating of silicone oil onto the off-set prevention layer of the fixing roller as C g, the amount of silicone oil coated per sheet of the transfer material (white paper) of A4 size×g is determined by the following formula:

$$x=(C+A_1-B-A_2)/50$$

Further, at a predetermined site of the fixing device 17 is provided a cleaning device 36 for removing the toner off-set onto the fixing roller 21. The cleaning device 36 comprises a cleaning web **37*a* which is contacted with the fixing roller 21 with a pressing roller 37, and cleaning of the fixing roller 21 is done with the cleaning web 37*a***.

Figure 5:
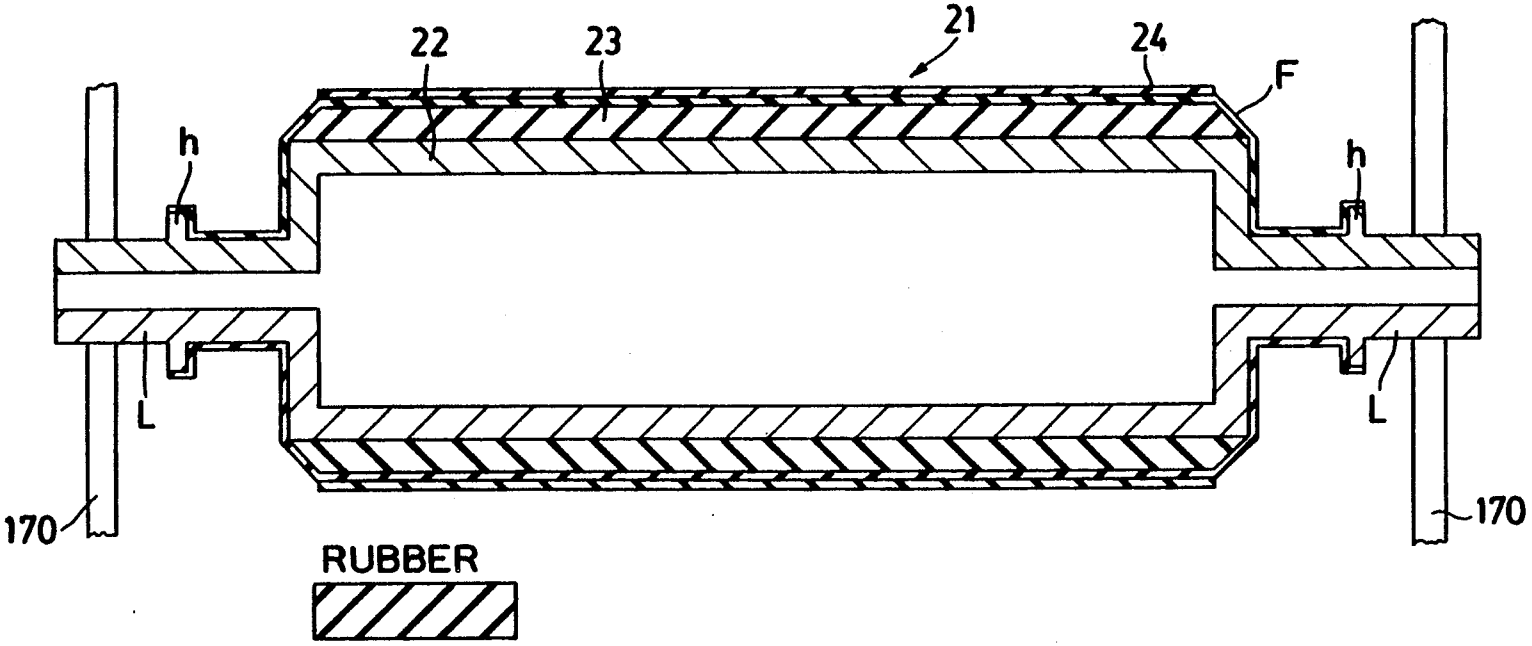
FIG. 5 is a longitudinal sectional view showing an embodiment of the fixing roller according to the present invention.

Here, the fixing roller to which the present invention is applied is described by use of FIG. 5.

As described above, the fixing roller 21 is constituted by successively coating an elastic layer 23 comprising an HTV silicone rubber, an oil barrier layer F comprising fluorine rubber and an LTV silicone rubber layer 24 as the release layer on the outer peripheral of the core metal 22 made of aluminum.

The above core metal 22 is molded in hollow shape, and the both ends thereof constitute the journal portion L, and the journal portion L is rotatably supported on the supporting member 170 of the fixing device. And, around the supporting portion is formed a mold release agent discharging portion h each integrally with the core metal 22 as to be projected therefrom. The mold release agent discharging portion h is larger than the outer diameter of the journal portion L, and provided over the whole circumference of the journal portion. In this embodiment, it is made circular shape.

And, in this embodiment, the oil barrier layer F covers the site between the above both release agent discharging portions h of the fixing roller 21. Therefore, the HTV silicone rubber layer 23 as a whole is completely covered with the oil barrier layer F including the both ends thereof, and penetration of the silicone oil as the mold release agent coated on the fixing roller 21 into the HTV silicone rubber is surely impeded by the oil barrier layer F, and the HTV silicone rubber layer 23 will not be deteriorated by swelling in contact with the silicone oil.

Whereas, the wettability of silicone oil with the fluorine rubber constituting the oil barrier layer F is extremely poor, and silicone oil is repellent on the oil barrier layer F.

And, in this embodiment, since the fixing roller 21 is covered with the oil barrier layer F at the site between the both release agent discharging portions h, even if the silicone oil remining on the fixing roller 21 may flow to the mold release agent discharging portion h, said silicone oil drops efficiently with its repellent force on the oil barrier layer F at the release discharging portion h to be removed from the fixing roller 21, whereby the silicone oil will not come over the mold release agent discharging portion h to reach the main device as in the prior art and therefore the machine will not be internally contaminated with silicone oil.

In the above embodiment, as the material of the oil barrier layer F, a fluorine rubber is employed, but in place thereof, one with poor wettability with oil such as fluorosilicone rubber or fluorine resin, etc. may be also employed (fluorine rubber is however preferable with respect to cost and adhesive force with lower layer material). Also, in the above embodiment, site between the both release agent discharging portions h of the fixing roller are covered with the oil barrier layer F, but the fixing roller 21 as a whole including both journal portions L, L may be also covered with the oil barrier layer F without any problem.

Further, the thickness of the oil barrier layer F may be preferably 5 μm to 300 μm, for the following reason. That is, if the thickness of the oil barrier layer F is less than 5 μm, there is the fear that the HTV silicone rubber layer 23 may be partially exposed due to coating irregularity of fluorine rubber, etc., whereby penetration of silicone oil into the HTV silicone rubber layer 23 cannot be completely prevented by the oil barrier layer F. On the other hand, if the thickness of the oil barrier layer F exceeds 300 μm, the hardness of the fixing roller as a whole may be increased, and the amount of thermal deformation of the fluorine rubber is large, whereby deformation of the nip 38 with the pressurizing roller 25 may occur when the fixing roller 21 is stopped for a long term. Therefore, the thickness of the oil barrier layer F may be preferably 5 μm to 300 μm, more preferably 8 μm to 100 μm.

As described above, since the whole elastic layer covered with the oil barrier layer, penetration of the mold release agent into said elastic layer is surely prevented by the oil barrier layer, whereby inconveniences such as swelling deterioration of the elastic layer by contact with the mold release agent can be cancelled.

Also, since at least the site between the both mold release agent discharging portions of the fixing roller is covered with the oil barrier layer with poor wettability with the mold release agent, even if the mold release agent may reach the mold release agent discharging portion by rotation of the fixing roller, the mold release agent can drop efficiently at the mold release agent discharging portion without reaching the main device, and the machine will not be internally contaminated with the mold release agent.

What is claimed is:

1. A rotatory member for fixing toner image onto a support member supporting toner image, having:

a core member having a projected portion around the journal portion;

an elastic layer provided on said core member;

an intermediate layer provided on said elastic layer; and a surface layer provided on said intermediate layer, wherein said intermediate layer is provided so as to cover over from said elastic layer to the projected portion of said core member.

2. A rotatory member for fixing according to claim 1, wherein a mold release agent for preventing off-set of toner is supplied to said rotatory member for fixing.

3. A rotatory member for fixing according to claim 2, wherein the projected portion of said core member is the portion which block movement of the mold release agent supplied to the rotatory member for fixing.

4. A rotatory member according to claim 3, wherein said intermediate layer is a layer which prevents penetration of the mold release agent into said elastic layer.

5. A rotatory member according to claim 4, wherein said intermediate layer is a layer with poor wettability with the mold release agent.

6. A rotatory member according to claim 5, wherein said mold release agent is a silicone oil.

7. A rotatory member according to any one of claims 1 to 6, wherein said elastic layer and said surface layer are respectively silicone rubber layers, and said intermediate layer is a fluorine rubber layer.

8. A fixing device according to claim 1, wherein said projected portion is provided at both ends of the rotatory member for fixing.

9. A fixing device for fixing toner image onto a support supporting a toner image, having:

a rotatory member for fixing for fixing toner image, said rotatory member for fixing having a core member having the portion for blocking movement of a mold release agent around the journal portion, an elastic layer provided on said core member, an intermediate layer provided on said elastic layer and a surface layer provided on said intermediate layer, said intermediate layer covering over from said elastic layer to the blocking portion of said core member; and a means for supplying a mold release agent to said rotatory member for fixing.

10. A fixing device according to claim 9, wherein said intermediate layer is a layer which prevents penetration of the mold release agent into said elastic layer.

11. A fixing device according to claim 9, wherein the blocking portion of said mold release agent is provided as projected from said journal portion.

12. A fixing device according to claim 9, wherein said intermediate layer is a layer with poor wettability with the mold release agent.

13. A fixing device according to any one of claims 9 to 12, wherein said mold release agent is a silicone oil.

14. A fixing device according to any one of claims 9 to 12, wherein said elastic layer and said surface layer are respectively rubber layers, and said intermediate layer is a fluorine rubber layer.

15. A fixing device according to claim 14, wherein said mold release agent is a silicone oil.

16. A fixing device according to claim 9, wherein said fixing device has another rotatory member for fixing which conveys said support member by cooperation with said rotatory member for fixing sandwiched therebetween.

17. A fixing device according to claim 16, wherein the rotatory member for fixing having said elastic layer, intermediate layer, surface layer is the rotatory member on the side in contact with unfixed toner image.

18. A fixing device according to claim 17, wherein at least one rotatory member fixing of said rotatory members for fixing is heated by a heating means.

19. A fixing device according to claim 18, wherein said fixing device is used for full-color image forming device.

20. A fixing device according to claim 8, wherein the blocking portion of said core member is provided at both ends of the rotatory member for fixing.

* * * * *

UNITED STATES PATENT AND TRADEMARK OFFICE

CERTIFICATE OF CORRECTION

PATENT NO. : 5,068,692

DATED : November 26, 1991

INVENTOR(S) : Takeshi Menjo

It is certified that error appears in the above-identified patent and that said Letters Patent is hereby corrected as shown below:

COLUMN 1:

Line 7, "for fixing" should be deleted.

COLUMN 2:

Line 15, "eliminates" should read --eliminate--.

and

Line 52, "approximate" should read --approximately--.

COLUMN 3:

Line 46, "descirbed" should read --described--.

COLUMN 8:

Line 20, "block" should read --blocks--.

Line 40, "for fixing for fixing" should read --for fixing--.

Signed and Sealed this

Fifteenth Day of June, 1993

*Attest:*

Michael K. Kirk

MICHAEL K. KIRK

*Attesting Officer*

*Acting Commissioner of Patents and Trademarks*